US006682035B1

(12) United States Patent
Hart

(10) Patent No.: US 6,682,035 B1
(45) Date of Patent: Jan. 27, 2004

(54) HAIR BAND HOLDER

(76) Inventor: Virginia R. Hart, 4003 Oakridge Dr., Crestwood, KY (US) 40014

( * ) Notice: Subject to any disclaimer, the term of this patent is extended or adjusted under 35 U.S.C. 154(b) by 6 days.

(21) Appl. No.: 09/586,688

(22) Filed: Jun. 1, 2000

(51) Int. Cl.[7] ..... A47F 5/00
(52) U.S. Cl. ..... 248/309.2; 248/309.1
(58) Field of Search ..... 248/309.2, 216.1, 248/309.1; 242/422.4, 596.3, 570, 900, 597.7; D6/521, 455; D28/73; 132/273; 206/581; 211/13.1, 4, 85.3, 163, 59.1, 44.1

(56) References Cited

U.S. PATENT DOCUMENTS

| | | | | | |
|---|---|---|---|---|---|
| 485,109 | A | | 10/1892 | Morrow | |
| 1,229,431 | A | * | 6/1917 | Farrell | 242/596 |
| 1,976,037 | A | * | 10/1934 | Rawlings | 242/137 |
| 2,410,328 | A | * | 10/1946 | Agamaite, Jr. | 242/596.3 |
| 2,517,809 | A | * | 8/1950 | Tarzian | 242/598.2 |
| 3,304,034 | A | * | 2/1967 | Jones | |
| D253,209 | S | | 10/1979 | Hayslett | D6/96 |
| 4,179,077 | A | * | 12/1979 | Morishita | 242/423 |
| D260,061 | S | | 8/1981 | Smith | D6/96 |
| 4,416,425 | A | * | 11/1983 | Kish | 242/598.1 |
| 4,432,504 | A | * | 2/1984 | Pace | 242/598.1 |
| 4,483,491 | A | * | 11/1984 | Rainey | 242/55.2 |
| 4,487,376 | A | | 12/1984 | Compton | 242/55.54 |
| D284,152 | S | | 6/1986 | Jerhammar | D6/521 |
| 4,792,102 | A | | 12/1988 | Olson | 242/55.54 |
| 4,824,038 | A | * | 4/1989 | Chandler | 242/55.2 |
| 4,890,730 | A | * | 1/1990 | Kovac | 206/303 |
| 4,955,557 | A | * | 9/1990 | Sewell et al. | 242/134 |
| 5,125,609 | A | | 6/1992 | Demeo | 248/216.1 |
| 5,433,643 | A | * | 7/1995 | Pratt | 446/73 |
| 5,450,981 | A | * | 9/1995 | Fields | 221/33 |
| D373,918 | S | | 9/1996 | Joergensen | D6/518 |
| D438,674 | S | * | 3/2001 | Russell | D28/73 |
| D457,271 | S | * | 5/2002 | Jackson | D28/73 |

* cited by examiner

*Primary Examiner*—Gwendolyn Baxter
(74) *Attorney, Agent, or Firm*—Carrithers Law Office; David W. Carrithers

(57) ABSTRACT

A hair band storage stand having a post and a support, offset from one another, projecting upwardly from a base and a flip-up lid hingedly attached to the support. The lid is notched at an edge opposite to the hinge to receive the post. The post below the lid is a primary storage magazine and above the lid serves as a temporary storage for a limited number of bands.

7 Claims, 1 Drawing Sheet

HAIR BAND HOLDER

BACKGROUND OF THE INVENTION

1. Technical Field

This invention relates in general to annular decorative hair band's known as twisters and more particularly to a stand for holding a supply of the same.

2. Background Information

Twisters, fluffy in nature, are normally stored all bunched up in a dresser drawer. They can occupy a large volume of space and while in the drawer it is hard to distinguish one from the other making it difficult to quickly view what is available and to select one to suit one's desire at the particular time of use.

Storage stands for roll and/or spool type articles are well known comprising generally a base and a post supported by and projecting upwardly from the base. In some of the devices there is a cap to keep the articles on the post. By way of example of known devices reference may be had to the following U.S. Des. Pat. No. 373,918 Issued Sep. 24, 1996 to C. Joergensen; U.S. Des. Pat. No. 284,152 Issued Jun. 10, 1986 to L. Jerhammar; U.S. Des. Pat. No. 260,061 Issued Aug. 4, 1981 to W. Smith; U.S. Des. Pat. No. 253,209 Issued Oct. 23, 1979 to M. Hayslett; and U.S. Des. Pat. No. 230,795 Issued Mar. 19, 1974 to C Birks. Other references considered pertinent to the instant invention include the following U.S. Pat. No. 5,125,609 Issued Jun. 30, 1992 to T. Demeo; U.S. Pat. No. 4,792,102 Issued Dec. 20, 1988 to D. Olson; U.S. Pat. No. 4,487,376 Issued Dec. 11, 1984 to F. Compton; and U.S. Des. Pat. No. 485,109 Issued Oct. 25, 1892 to F. Morrow.

In the forgoing patent U.S. Pat. No. 4,792,102 the is a cap member that swings to one side or the other to uncover and release the roll on the post. In U.S. Pat. No. 4,487,376 the cap is a removable knob and in U.S. Des. Pat. No. 485,109 there is an arm that swings into and out of position.

SUMMARY OF INVENTION

An object of the present invention is to provide a stand with a post for holding the annular objects in a stack and a flip up lid that overlies the objects on the post. The lid can serve to separate a few of the most frequently used bands from the remainder.

In keeping with the forgoing there is provided a base, an elongate post secured to and projecting upwardly from said base, a support secured to and projecting upwardly from said base and offset laterally from said post, said support terminating in a free upper end, a flip up lid comprising a plate like member and hinge means pivotally attaching said plate like member, adjacent one edge thereof, to the upper end of said support, said lid having a slot extending inwardly from an edge thereof, opposite said hinge, to receive therein a portion of said post.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
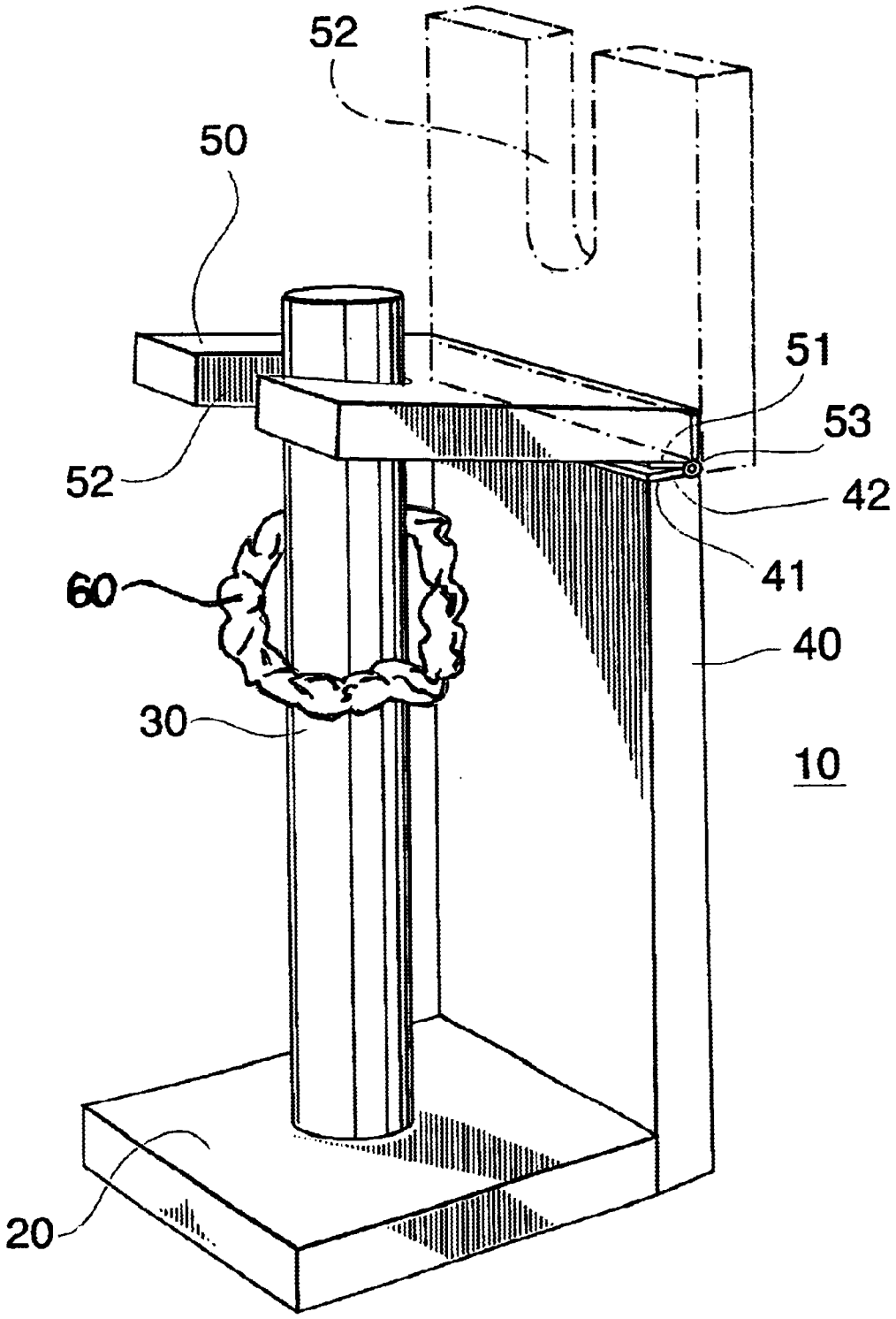
FIG. 1 is an oblique view of the hair band holder provided in accordance with the present invention showing the base, elongated post, and support projecting upwardly from the base terminating in a pivotally connected upper end.

Referring to the drawing of FIG. 1, there is illustrated a hair band stand 10 comprises a base 20, a post 30 secured to and projecting upwardly from the base, a support 40 mounted on the base and offset laterally from the post and a flip-up lid member 50 pivotally attached to the upper end of the post.

The support 40 terminates in a free upper end 41 to which there is attached a hinge plate 42. The plate-like lid 50 has a hinge plate 51 attached thereto adjacent one edge thereof and a notch 52 extends inwardly from the opposite edge. The hinge plates are interconnected by a pin 53 and the notch receives therein an upper portion of the post. The post portion, below the flip-up lid, is a magazine primary storage area for several hair bands which can readily placed on or removed from the post when the lid is flipped up. When the lid is flipped down it can serve as a support for a few of the most frequently used bands 60.

The device is simple yet effective in organizing the pony tail holders and can be stored in a readily accessible place for use at any time. For transport purposes the flip-up lid can if desired be anchored to the post by a wedge or pin or some other convenient means.

The base 20, support 40 and flip-up lid 50 can be molded, if desired, from a plastics material and the hinge formed integral therewith as a line of weakness as is well known in molding techniques.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A hair band holder, comprising:

an annular hair band;

a base;

an elongate post secured to and projecting upwardly from said base;

a support secured to and projecting upwardly from said base at a position offset laterally from said elongate post, said support terminating in a free upper end;

a flip-up lid comprising a plate member;

means for hinging pivotally attaching said plate member, adjacent one edge thereof, to an upper end of said support;

said lid having a U-shaped notch extending inwardly from an edge opposite said means for hinging to a generally central position of said plate member, wherein said plate member pivots relative to said post receiving same upon closure.

2. The hair band holder of claim 1, wherein said post projects upwardly beyond said flip-up lid providing storage for a limited number of hair bands.

3. The hair band holder of claim 1, said U-shaped notch extending through said plate member at least half way.

4. The hair band holder of claim 1, said elongate post extending through said U-shaped notch and said plate member.

5. The hair band holder of claim 1, wherein said elongate post is stationary.

6. A hair band holder, comprising:

at least one annular hair band;

a post secured to and projecting upwardly from said base;

a support secured to and projecting upwardly from said base at a position offset laterally from said post, said support terminating in a free upper end;

a flip-up lid comprising a plate member;

means for hinging pivotally attaching said plate member, adjacent one edge thereof, to an upper end of said support;

said lid having a U-shaped notch extending inwardly from an edge opposite said means for hinging to a generally central position of said plate member, wherein said plate member pivots relative to said post receiving same upon closure; and said means for hinging pivotally attaching said plate member to said support wherein said at least one annular hair band is supported on said post.

7. A hair band holder, comprising:

at least one annular hair band;

a base;

an elongate member secured to and projecting upwardly from said base, wherein said elongate member is permanently affixed normal to said base;

a support secured to and projecting upwardly from said base at a position offset laterally from said elongate member, said support terminating in a free upper end;

a flip-up lid comprising a plate member;

means for hinging pivotally attaching said plate member, adjacent one edge thereof, to an upper end of said support;

said lid having a U-shaped notch extending inwardly from an edge opposite said means for hinging to a generally central position of said plate member, wherein said plate member pivots relative to said post receiving same upon closure, wherein said at least one annular hair band is supported on said elongate member.

* * * * *